US010295185B2

(12) United States Patent
Colannino et al.

(10) Patent No.: US 10,295,185 B2
(45) Date of Patent: May 21, 2019

(54) FLAME VISUALIZATION CONTROL FOR ELECTRODYNAMIC COMBUSTION CONTROL

(71) Applicant: ClearSign Combustion Corporation, Seattle, WA (US)

(72) Inventors: Joseph Colannino, Bellevue, WA (US); Jesse Dumas, Seattle, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 390 days.

(21) Appl. No.: 15/098,657

(22) Filed: Apr. 14, 2016

(65) Prior Publication Data

US 2016/0298836 A1 Oct. 13, 2016

Related U.S. Application Data

(63) Continuation of application No. PCT/US2014/060534, filed on Oct. 14, 2014.

(60) Provisional application No. 61/890,668, filed on Oct. 14, 2013.

(51) Int. Cl.

| | |
|---|---|
| ***F23N 1/02*** | (2006.01) |
| ***F23C 99/00*** | (2006.01) |
| ***F23N 5/08*** | (2006.01) |

(52) U.S. Cl.

CPC ..... *F23N 1/022* (2013.01); *F23C 99/001* (2013.01); *F23N 5/08* (2013.01); *F23N 5/082* (2013.01); *F23D 2203/102* (2013.01); *F23D 2208/10* (2013.01); *F23N 2029/04* (2013.01); *F23N 2029/20* (2013.01)

(58) Field of Classification Search

CPC ..... F23C 99/001; F23N 1/022; F02C 1/00
USPC ..... 431/2; 348/61
See application file for complete search history.

(56) References Cited

U.S. PATENT DOCUMENTS

| | | | |
|---|---|---|---|
| 2,604,936 | A | 7/1952 | Kaehni et al. |
| 3,004,137 | A | 10/1961 | Karlovitz |
| 3,087,472 | A | 4/1963 | Yukichi |
| 3,167,109 | A | 1/1965 | Wobig |
| 3,224,485 | A | 12/1965 | Blomgren, Sr. et al. |

(Continued)

FOREIGN PATENT DOCUMENTS

| | | |
|---|---|---|
| EP | 0844434 | 5/1998 |
| EP | 1139020 | 8/2006 |

(Continued)

OTHER PUBLICATIONS

Isaksen, Øyvind; "Reconstruction Techniques for Capacitance Tomography," Meas. Sci. Technol., vol. 7, No. 3 (1996), pp. 325-337.

(Continued)

*Primary Examiner* — Gregory L Huson
*Assistant Examiner* — Nikhil P Mashruwala
(74) *Attorney, Agent, or Firm* — Christopher A. Wiklof; David C. Conlee; Launchpad IP, Inc.

(57) ABSTRACT

A combustion system includes, burner, a camera, and a control circuit. The burner initiates a combustion reaction. The camera takes a plurality of images of the combustion reaction. The control circuit produces from the images an averaged image and adjusts the combustion reaction based on the adjusted image.

31 Claims, 8 Drawing Sheets

(56) References Cited

U.S. PATENT DOCUMENTS

| | | | | |
|---|---|---|---|---|
| 3,306,338 | A | 2/1967 | Wright et al. | |
| 3,416,870 | A | 12/1968 | Wright | |
| 3,749,545 | A | 7/1973 | Velkoff | |
| 3,841,824 | A | 10/1974 | Bethel | |
| 4,020,388 | A | 4/1977 | Pratt, Jr. | |
| 4,111,636 | A * | 9/1978 | Goldberg | F23C 99/001 431/2 |
| 4,239,973 | A | 12/1980 | Kolbe et al. | |
| 4,737,844 | A | 4/1988 | Kohola et al. | |
| 4,910,637 | A | 3/1990 | Hanna | |
| 5,577,905 | A | 11/1996 | Momber et al. | |
| 5,702,244 | A | 12/1997 | Goodson et al. | |
| 5,784,889 | A | 7/1998 | Joos et al. | |
| 7,243,496 | B2 | 7/2007 | Pavlik et al. | |
| 7,944,678 | B2 | 5/2011 | Kaplan et al. | |
| 8,851,882 | B2 | 10/2014 | Hartwick et al. | |
| 8,881,535 | B2 * | 11/2014 | Hartwick | F23D 14/84 431/8 |
| 8,911,699 | B2 | 12/2014 | Colannino et al. | |
| 9,151,549 | B2 | 10/2015 | Goodson et al. | |
| 9,209,654 | B2 | 12/2015 | Colannino et al. | |
| 9,243,800 | B2 | 1/2016 | Goodson et al. | |
| 9,267,680 | B2 | 2/2016 | Goodson et al. | |
| 9,284,886 | B2 | 3/2016 | Breidenthal et al. | |
| 9,289,780 | B2 | 3/2016 | Goodson | |
| 9,310,077 | B2 | 4/2016 | Breidenthal et al. | |
| 9,366,427 | B2 | 6/2016 | Sonnichsen et al. | |
| 9,371,994 | B2 | 6/2016 | Goodson et al. | |
| 9,377,188 | B2 | 6/2016 | Ruiz et al. | |
| 9,377,189 | B2 | 6/2016 | Ruiz et al. | |
| 9,377,195 | B2 | 6/2016 | Goodson et al. | |
| 10,156,356 | B2 * | 12/2018 | Colannino | F23N 5/082 |
| 2002/0088442 | A1 | 7/2002 | Hansen et al. | |
| 2003/0003590 | A1 | 1/2003 | Abbasi et al. | |
| 2005/0208442 | A1 | 9/2005 | Heiligers et al. | |
| 2007/0020567 | A1 | 1/2007 | Branston et al. | |
| 2011/0072786 | A1 | 3/2011 | Tokuda et al. | |
| 2011/0085030 | A1 | 4/2011 | Poe et al. | |
| 2012/0135360 | A1 | 5/2012 | Hannum et al. | |
| 2013/0071794 | A1 | 3/2013 | Colannino et al. | |
| 2013/0230810 | A1 | 9/2013 | Goodson et al. | |
| 2013/0260321 | A1 | 10/2013 | Colannino et al. | |
| 2013/0291552 | A1 | 11/2013 | Smith et al. | |
| 2013/0323655 | A1 | 12/2013 | Krichtafovitch et al. | |
| 2013/0323661 | A1 | 12/2013 | Goodson et al. | |
| 2013/0333279 | A1 | 12/2013 | Osler et al. | |
| 2013/0336352 | A1 | 12/2013 | Colannino et al. | |
| 2014/0051030 | A1 | 2/2014 | Colannino et al. | |
| 2014/0065558 | A1 | 3/2014 | Colannino et al. | |
| 2014/0076212 | A1 | 3/2014 | Goodson et al. | |
| 2014/0080070 | A1 | 3/2014 | Krichtafovitch et al. | |
| 2014/0162195 | A1 | 6/2014 | Lee et al. | |
| 2014/0162196 | A1 | 6/2014 | Krichtafovitch et al. | |
| 2014/0162197 | A1 | 6/2014 | Krichtafovitch et al. | |
| 2014/0162198 | A1 | 6/2014 | Krichtafovitch et al. | |
| 2014/0170569 | A1 | 6/2014 | Anderson et al. | |
| 2014/0170571 | A1 | 6/2014 | Casasanta, III et al. | |
| 2014/0170575 | A1 | 6/2014 | Krichtafovitch | |
| 2014/0170576 | A1 | 6/2014 | Colannino et al. | |
| 2014/0170577 | A1 | 6/2014 | Colannino et al. | |
| 2014/0186778 | A1 | 7/2014 | Colannino et al. | |
| 2014/0196368 | A1 | 7/2014 | Wiklof | |
| 2014/0196369 | A1 | 7/2014 | Wiklof | |
| 2014/0208758 | A1 | 7/2014 | Breidenthal et al. | |
| 2014/0212820 | A1 | 7/2014 | Colannino et al. | |
| 2014/0216401 | A1 | 8/2014 | Colannino et al. | |
| 2014/0227645 | A1 | 8/2014 | Krichtafovitch et al. | |
| 2014/0227646 | A1 | 8/2014 | Krichtafovitch et al. | |
| 2014/0227649 | A1 | 8/2014 | Krichtafovitch et al. | |
| 2014/0248566 | A1 | 9/2014 | Krichtafovitch et al. | |
| 2014/0255855 | A1 | 9/2014 | Krichtafovitch | |
| 2014/0255856 | A1 * | 9/2014 | Colannino | F23N 5/00 431/2 |
| 2014/0272731 | A1 | 9/2014 | Breidenthal et al. | |
| 2014/0287368 | A1 | 9/2014 | Krichtafovitch et al. | |
| 2014/0295094 | A1 | 10/2014 | Casasanta, III | |
| 2014/0295360 | A1 | 10/2014 | Wiklof | |
| 2014/0335460 | A1 | 11/2014 | Wiklof et al. | |
| 2015/0079524 | A1 | 3/2015 | Colannino et al. | |
| 2015/0104748 | A1 | 4/2015 | Dumas et al. | |
| 2015/0107260 | A1 | 4/2015 | Colannino et al. | |
| 2015/0121890 | A1 | 5/2015 | Colannino et al. | |
| 2015/0140498 | A1 | 5/2015 | Colannino | |
| 2015/0147704 | A1 | 5/2015 | Krichtafovitch et al. | |
| 2015/0147705 | A1 | 5/2015 | Colannino et al. | |
| 2015/0147706 | A1 | 5/2015 | Krichtafovitch et al. | |
| 2015/0219333 | A1 | 8/2015 | Colannino et al. | |
| 2015/0226424 | A1 | 8/2015 | Breidenthal et al. | |
| 2015/0241057 | A1 | 8/2015 | Krichtafovitch et al. | |
| 2015/0276211 | A1 | 10/2015 | Colannino et al. | |
| 2015/0338089 | A1 | 11/2015 | Krichtafovitch et al. | |
| 2015/0345780 | A1 | 12/2015 | Krichtafovitch | |
| 2015/0345781 | A1 | 12/2015 | Krichtafovitch et al. | |
| 2015/0369476 | A1 | 12/2015 | Wiklof | |
| 2016/0033125 | A1 | 2/2016 | Krichtafovitch et al. | |
| 2016/0040872 | A1 | 2/2016 | Colannino et al. | |
| 2016/0047542 | A1 | 2/2016 | Wiklof et al. | |
| 2016/0123576 | A1 | 5/2016 | Colannino et al. | |
| 2016/0138800 | A1 | 5/2016 | Anderson et al. | |
| 2016/0161110 | A1 | 6/2016 | Krichtafovitch et al. | |
| 2016/0161115 | A1 | 6/2016 | Krichtafovitch et al. | |
| 2016/0215974 | A1 | 7/2016 | Wiklof | |
| 2018/0031229 | A1 * | 2/2018 | Karkow | F23C 99/001 |

FOREIGN PATENT DOCUMENTS

| | | |
|---|---|---|
| JP | 60-216111 | 10/1985 |
| JP | 61-265404 | 11/1986 |
| WO | WO 1995/034784 | 12/1995 |
| WO | WO 1996/001394 | 1/1996 |
| WO | WO 2013/181569 | 12/2013 |
| WO | WO 2015/017084 | 2/2015 |
| WO | WO 2015/038245 | 3/2015 |
| WO | WO 2015/042566 | 3/2015 |
| WO | WO 2015/051136 | 4/2015 |
| WO | WO 2015/089306 | 6/2015 |
| WO | WO 2015/103436 | 7/2015 |
| WO | WO 2016/003883 | 1/2016 |
| WO | WO 2016/018610 | 2/2016 |

OTHER PUBLICATIONS

M. Zake et al., "Electric Field Control of NOx Formation in the Flame Channel Flows." Global Nest: The Int. J., May 2000, vol. 2, No. 1, pp. 99-108.

Waterfall, R.C., et al.; "Flame Visualizations Using Electrical Capacitance Tomography (ECT)," Process Imaging for Automatic Control, Proc. SPIE, vol. 4188 (2001), pp. 242-250.

B. Stratton et al., "Determining Flame Height and Flame Pulsation Frequency and Estimating Heat Release Rate from 3D Flame Reconstruction." Fire Engineering Research Report 05/2, Dept. of Civil Engineering, Univ. of Canterbury, Christchurch, New Zealand, Jul. 2005, 90 pages.

Liu, S., et al.; "Preliminary Study on ECT Imaging of Flames in Porous Media," Meas. Sci. Technol., vol. 19, No. 9 (2008), 7 pages.

PCT International Search Report and Written Opinion of PCT Application No. PCT/US2014/060534, dated Jan. 19, 2015.

* cited by examiner

FLAME VISUALIZATION CONTROL FOR ELECTRODYNAMIC COMBUSTION CONTROL

CROSS REFERENCE TO RELATED APPLICATIONS

The present application is a U.S. Continuation Application which claims priority benefit under 35 U.S.C. § 120 (pre-AIA) of co-pending International Patent Application No. PCT/US2014/060534, entitled "FLAME VISUALIZATION CONTROL FOR ELECTRODYNAMIC COMBUSTION CONTROL," filed Oct. 14, 2014; which application claims priority benefit from U.S. Provisional Patent Application No. 61/890,668, entitled "ELECTRODYNAMIC COMBUSTION CONTROL (ECC) TECHNOLOGY FOR BIOMASS AND COAL SYSTEMS," filed Oct. 14, 2013 , co-pending at the date of filing; each of which, to the extent not inconsistent with the disclosure herein, is incorporated herein by reference.

BACKGROUND

In combustion systems it is often desirable to obtain a combustion reaction having selected characteristics. For instance, it can be beneficial for a particular a combustion system to receive uniform heat over a particular volume, or for a portion of the combustion system to receive more heat than other parts of the combustion system—for example to tailor a heat flux profile along the process tubes of certain furnaces. Likewise, it can be beneficial for the combustion reaction to have a particular width, length, or temperature.

SUMMARY

One embodiment is a combustion system comprising a burner configured to sustain a combustion reaction. The combustion system includes a camera configured to capture a plurality of images of the combustion reaction. A control circuit is configured to receive the plurality of images from the camera and to produce from the plurality of images an averaged image of the combustion reaction. The control circuit is configured to adjust the combustion reaction based on the averaged image.

In one embodiment the combustion system includes a memory configured to store reference data. The control circuit compares the averaged image to the control data and adjusts the combustion reaction based on the comparison of the averaged image and the reference data.

In one embodiment the reference data includes one or more combustion reaction reference images. Each reference image corresponds to a combustion reaction having particular characteristics. The control circuit is configured to adjust the combustion reaction to conform to a selected one of the reference images.

In one embodiment the combustion system includes one or more field electrodes positioned in or near a combustion reaction region of the combustion system, a counter electrode, and a voltage source configured to apply a voltage between the field electrode and the counter electrode. The control circuit can adjust the combustion reaction by applying or adjusting the voltage between the field electrode and the counter electrode.

In one embodiment the combustion system includes a fuel nozzle configured to output fuel for the combustion reaction. The control circuit can adjust the combustion reaction by adjusting the output of fuel from the fuel nozzle. For example, the control circuit can adjust the combustion reaction by adjusting the velocity of the fuel, the flow rate of the fuel, the concentration of the fuel in a mixture, the direction of the flow of fuel, etc.

In one embodiment the combustion system includes adjustment of a parameter related to the oxygen concentration: airflow velocity, mass or volume flow of air, and other air-related parameters are understood to of necessity relate to the oxygen concentration. The control circuit can adjust the combustion reaction by adjusting the output of air from a variable frequency air fan, louvers on an air register, or other means of air or oxygen control. For example, the control circuit can adjust the combustion reaction by adjusting the velocity of the air, the airflow rate of the fuel, the concentration of the oxygen in a mixture, the direction of the airflow of fuel, etc.

DETAILED DESCRIPTION

Figure 1:
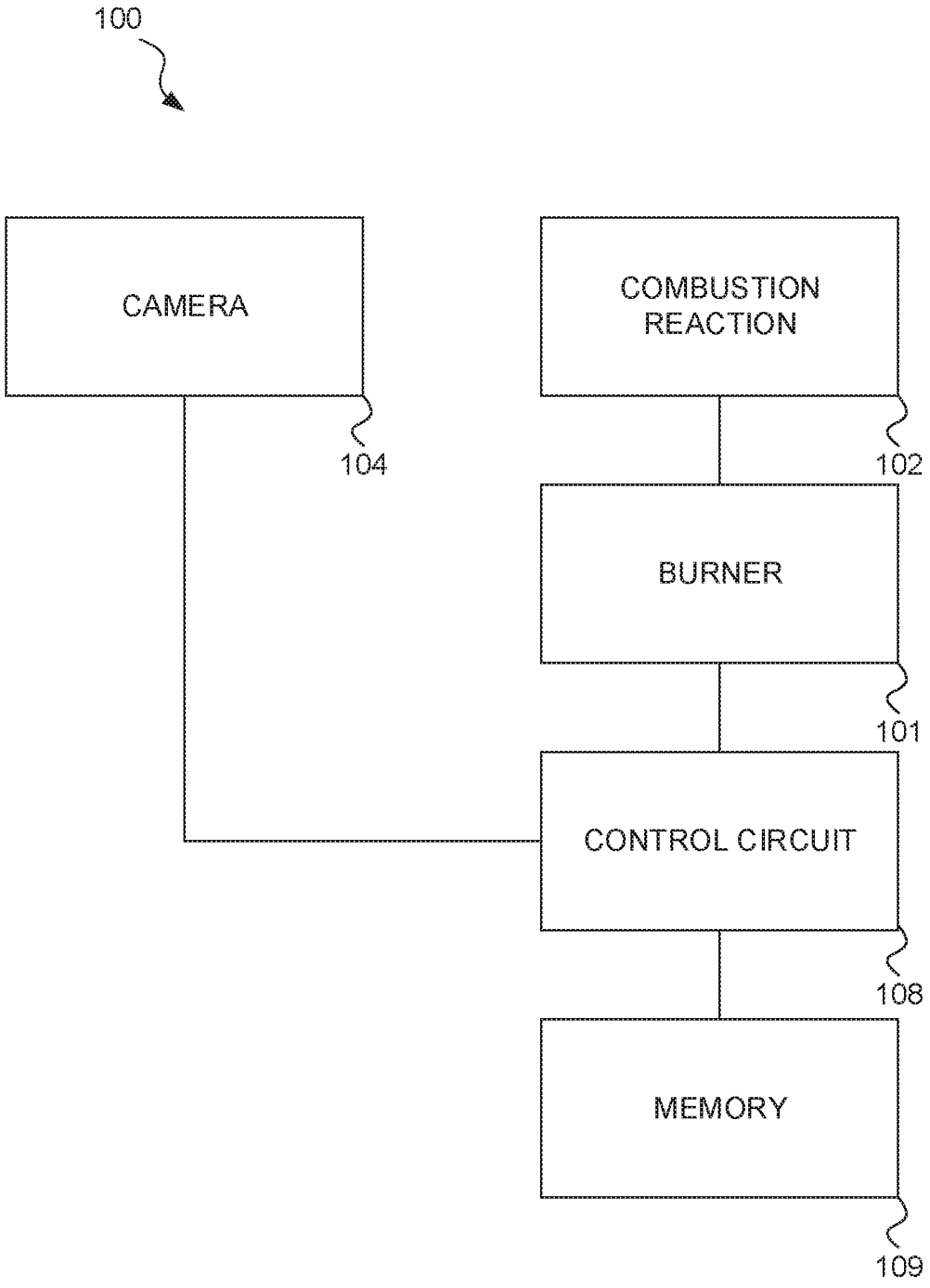
FIG. 1 is a block diagram of a combustion system, according to one embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

FIG. 1 is a block diagram of a combustion system 100 according to one embodiment. The combustion system 100 includes a burner 101 configured to sustain a combustion reaction 102. A camera 104 is positioned to capture images of the combustion reaction 102. A control circuit 108 is coupled to the camera 104 and the burner 101. A memory 109 is also coupled to the control circuit 108.

The camera 104 captures a plurality of successive images of the combustion reaction 102. Each of the images corresponds the combustion reaction 102 at a particular moment. Because the combustion reaction 102 is constantly moving, each of the images captured by the camera 104 will have the combustion reaction 102 in a different position.

Because of the amount of movement in flame location, it can be very difficult to determine whether or not a particular image corresponds to a selected flame shape or selected flame characteristics. The inventors discovered that, by averaging a number of successive image frames, a truer representation of flame characteristics can be obtained. The averaged image frames can thus be used for feedback control of the combustion system 100.

The camera 104 provides the plurality of images to the control circuit 108. The control circuit 108 produces from the plurality of images an averaged image of the combustion reaction 102. The averaged image provides information about the average position and heat profile of the combustion reaction 102. The averaged image can therefore give an indication of how much heat is applied to various areas of a combustion volume. The control circuit 108 can adjust the combustion reaction 102 based on the averaged image in order to obtain a combustion reaction 102 with selected characteristics.

In one embodiment, the memory stores combustion reaction reference data. These data may also be collected from the as-new or as-desired operating condition to be stored as combustion reaction reference data. After the control circuit 108 has produced the averaged image of the combustion reaction 102, the control circuit 108 can compare the averaged image to the reference data stored in the memory 109. In this way the control circuit 108 can determine if the combustion reaction 102 has characteristics in accordance with characteristics selected by an operator of the combustion system 100 or stored in the memory 109. Based on the comparison between the averaged image and the reference data stored in the memory 109, the control circuit 108 can adjust the combustion reaction 102 to achieve the selected characteristics.

After the control circuit 108 has adjusted the combustion reaction 102, the camera 104 captures another series of images of the combustion reaction 102. The control circuit 108 produces another averaged image of the combustion reaction 102 from the most recent series of images captured by the camera 104. The control circuit 108 compares the new averaged image to the reference data stored in the memory 109. If the comparison indicates that the combustion reaction 102 has characteristics substantially in accordance with the selected characteristics, then the control circuit 108 does not adjust the combustion reaction 102. If the comparison indicates that the combustion reaction 102 still has not achieved the selected characteristics, then the control circuit 108 can further adjust the combustion reaction 102.

In one embodiment, the reference data stored in the memory 109 includes a plurality of reference images of the combustion reaction 102. The control circuit 108 compares the averaged image of the combustion reaction 102 to one or more of the reference images. Based on the comparison of the averaged image to the reference images, the control circuit 108 can adjust the combustion reaction 102.

In one embodiment, the desired characteristics of the combustion reaction 102 correspond to a particular target reference image stored in the memory 109. The control circuit 108 compares the averaged image to the target reference image corresponding to the selected characteristics for the combustion reaction 102. The control circuit 108 then adjusts the combustion reaction 102 based on the comparison between the averaged image and the target reference image in order to conform the combustion reaction 102 to the target reference image.

In one embodiment, the camera 104 is a video camera that records a video of the combustion reaction 102. The control circuit 108 than averages the individual frames of the video to produce the averaged image. The camera 104 can be an infrared camera, a visible light camera, an ultraviolet light camera or any other suitable image capture device that can capture images of a combustion reaction 102.

The control circuit 108 can adjust the combustion reaction 102 in a variety of ways. In one embodiment, the burner 101 includes one or more fuel nozzles that emit gaseous or liquid fuel for the combustion reaction 102, the control circuit 108 can adjust the velocity of the fuel, the flow rate of the fuel, the direction of flow of the fuel, or the concentration of fuel and the mixture in order to obtain a combustion reaction 102 with selected characteristics. The control circuit 108 may also adjust the air or air/fuel ratio or one or more other combustion control parameters. Alternatively, the combustion system 100 can include one or more electrodes positioned in or adjacent to a combustion space of the combustion system 100. A voltage source can output to the electrode a high-voltage, thereby creating an electric field in the vicinity of the electrode that can affect the combustion reaction 102 in the selected manner. For example, the electric field can cause the combustion reaction 102 to expand or contract in length or width, can bend the combustion reaction 102 in a selected direction in order to impart more heat to a particular area of the combustion system 100, or can more fully combust the fuel.

In one embodiment the combustion system 100 includes a display coupled to the control circuit 108. The control circuit displays the averaged image of the combustion reaction 102 on the display. A technician can then manually adjust the combustion reaction 102 by manipulating controls of the combustion system 100. Alternatively, the display can display both the averaged image and the selected reference image.

Figure 2A:
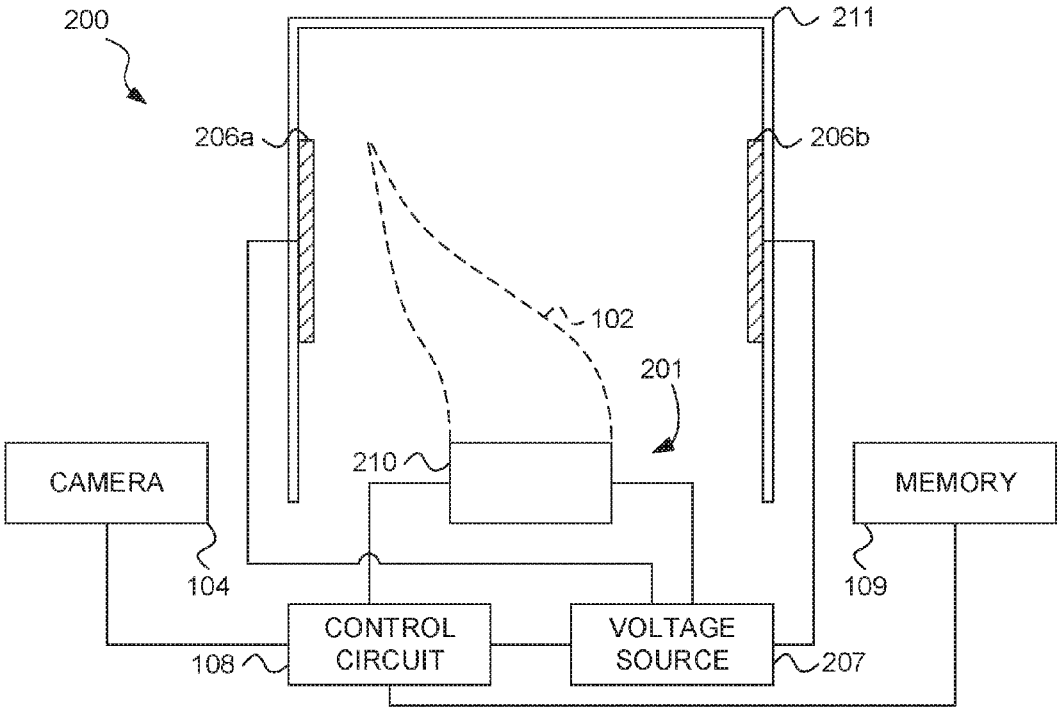
FIGS. 2A-2C are diagrams of a combustion system with the combustion reaction in particular positions corresponding to respective images of the combustion reaction captured by a camera, according to one embodiment.

FIG. 2A is a diagram of a combustion system 200 according to one embodiment. The combustion system 200 includes a burner 201 that sustains a combustion reaction 102 within a combustion volume defined by furnace walls 211. The burner 201 includes a combustion reaction holder 210 that holds the combustion reaction 102. The combustion system 200 further includes field electrodes 206*a*, 206*b*. A voltage source 207 is coupled to the field electrodes 206*a*, 206*b* and to the combustion reaction holder 210. A control circuit 108 is coupled to the voltage source 207 and to the burner 201. A camera 104 and the memory 109 are coupled to the control circuit 108. The function of the electrodes 206*a*, 206*b*, the voltage source 207, and the combustion reaction holder 210 is be described in more detail further below.

In FIG. 2A, due to the random motion of the combustion reaction, the combustion reaction 102 is bent toward the field electrode 206*a*. The camera 104 captures an image of the combustion reaction 102 when it is bent to the left toward the electrode 206*a* as seen in FIG. 2A.

Figure 2B:
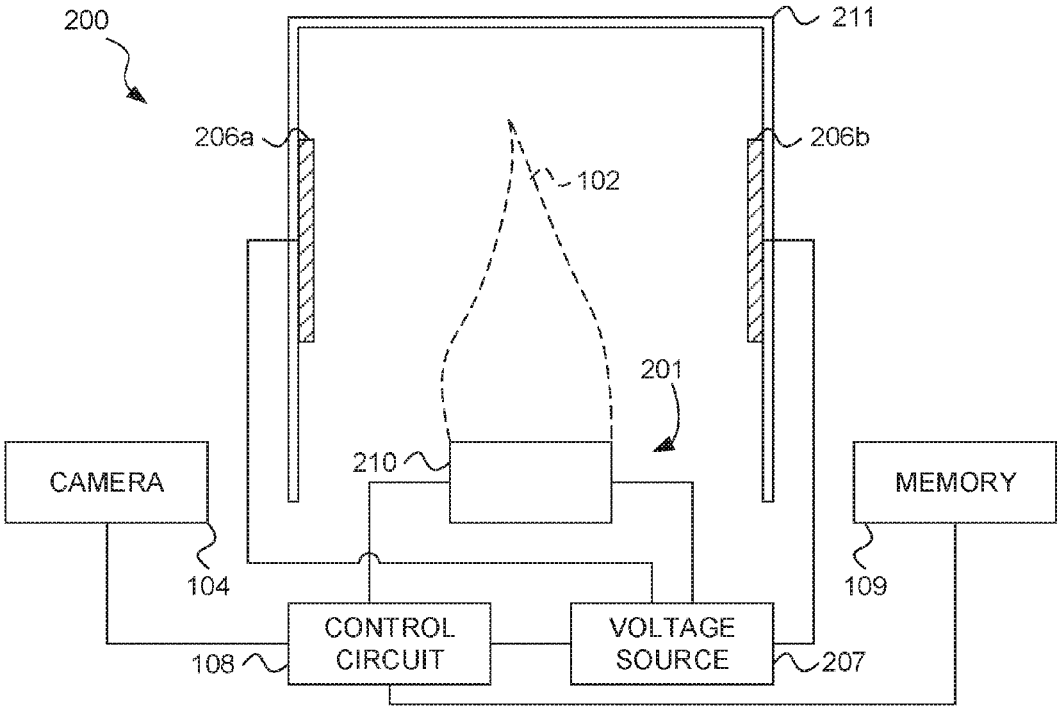

FIG. 2B is a diagram of the combustion system 200 a very brief time after the camera 104 has captured the image of the combustion reaction 102 in FIG. 2A. In FIG. 2B the combustion reaction 102 extends more vertically than in FIG. 2A. The camera 104 captures a second image of the combustion reaction 102 in the position shown in FIG. 2B.

Figure 2C:
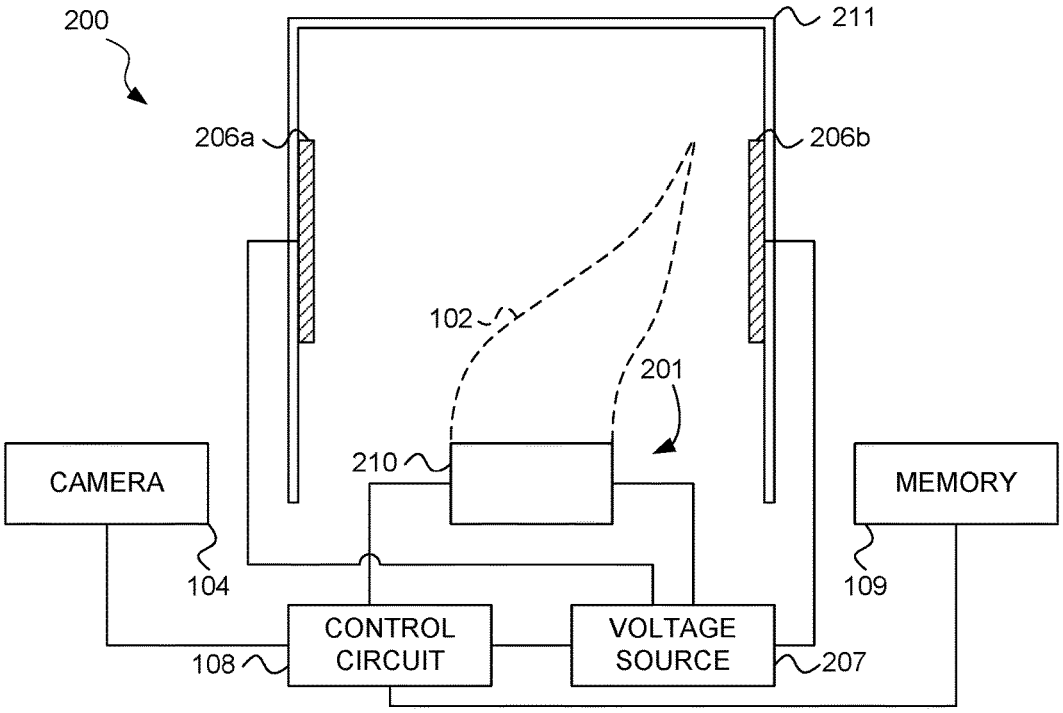

FIG. 2C is a diagram of the combustion system 200 a very brief time after the camera 104 has captured the image of the combustion reaction 102 in FIG. 2B. In FIG. 2C the combustion reaction 102 is bent to the right toward the field electrode 206*b*. The camera 104 captures a third image of the combustion reaction 102 in the position shown in FIG. 2C.

Figure 2D:
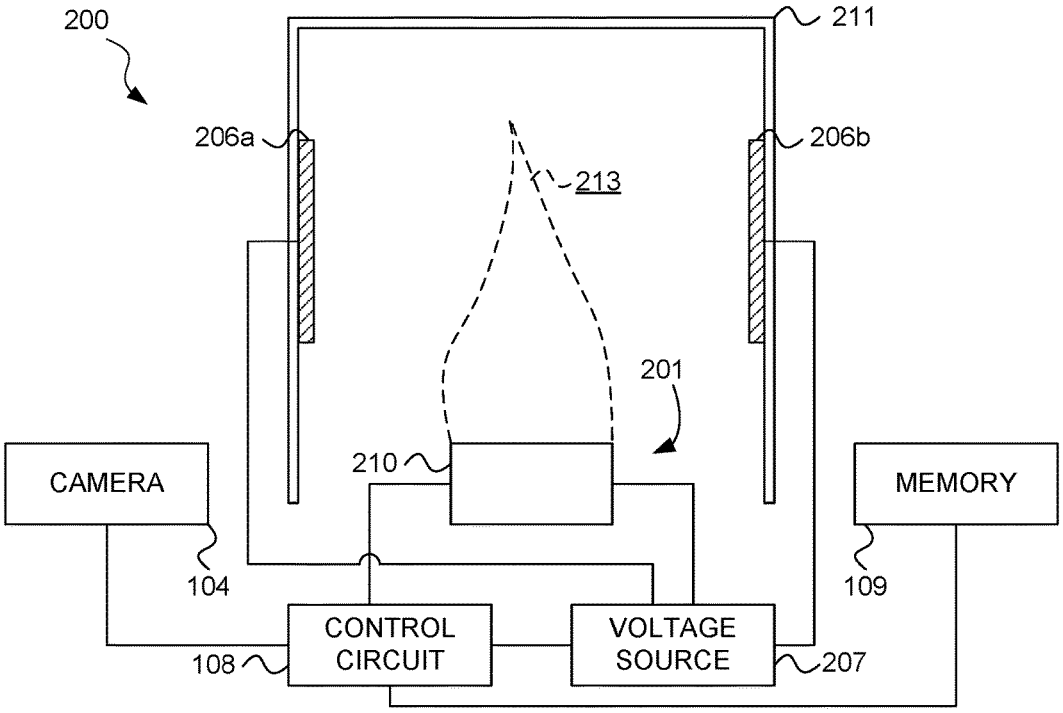
FIG. 2D is a diagram of a combustion system with an averaged image of the combustion reaction produced from the combustion reaction images of FIGS. 2A-2C, according to one embodiment.

FIG. 2D is a diagram of a combustion system 200 with an averaged image 213 of the combustion reaction produced from the combustion reaction 102 images of FIGS. 2A-2C, according to one embodiment. The control circuit 108 receives the images of the combustion reaction 102 corresponding to FIGS. 2A-2C from the camera 104. The control circuit 108 produces from the images of the combustion reaction 102 the averaged image 213 of the combustion reaction 102 shown in dashed lines in FIG. 2D. The averaged image 213 of the combustion reaction 102 shows the average position of the combustion reaction 102 from the images captured by the camera 104.

While the averaged image 213 has been described as being produced from three images of the combustion reaction, in practice the averaged image 213 can be produced from dozens or hundreds of images of the combustion reaction 102.

After the averaged image 213 has been produced, the control circuit 108 compares the averaged image 213 to one or more reference images stored in the memory 109. The reference images can correspond to particular target combustion reaction profiles that can be selected for the combustion reaction 102.

Figure 3A:
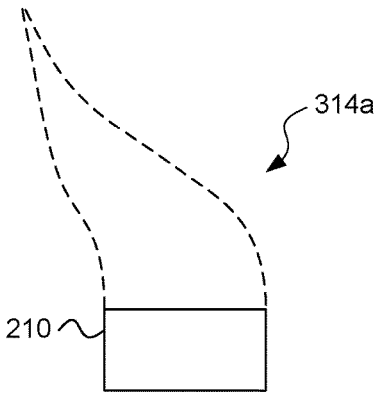
FIGS. 3A-3D are illustrations of combustion reaction reference images stored in a memory of the combustion system, according to one embodiment.
Figure 3B:
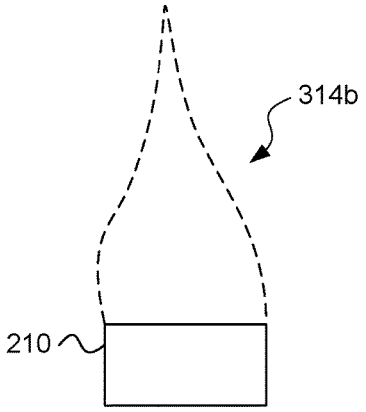
Figure 3C:
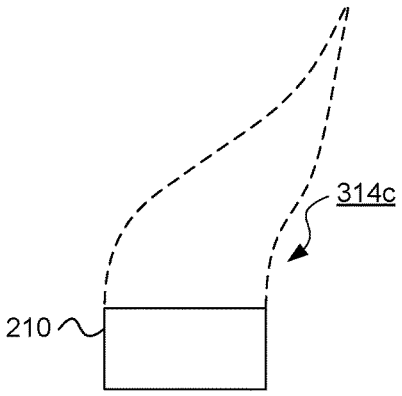
Figure 3D:
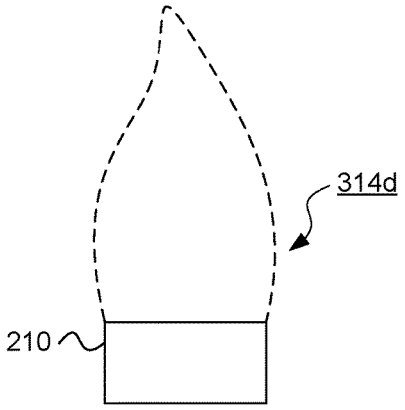

FIGS. 3A-3D are illustrations of example reference images 314*a-d* that can be stored in the memory 109, according to embodiments. In FIG. 3A, a reference image 314*a* bends to the left of the combustion reaction holder 210. In FIG. 3B the reference image 314*b* extends vertically and has a width larger than the combustion reaction holder 210. In FIG. 3C the reference image 314*c* bends to the right of the combustion reaction holder 210. In FIG. 3D the reference image 314*d* extends straight up and has a wider profile than the reference image 314*b* shown in FIG. 3B.

Each of the reference images 314*a-d* corresponds to a possible target shape for the combustion reaction 102. For example, it may be desirable in one circumstance for the combustion reaction 102 to bend to the left or to the right in order to heat a particular portion of the wall 211 of the combustion system 200. Alternatively, it may be desirable in another application for the combustion reaction to extend relatively high in the vertical direction. In another application it may be desirable for the combustion reaction 102 to be contracted vertically and widened laterally as shown in FIG. 3D. Those of skill in the art will understand that many shapes and profiles for a reference image are possible in view of the present disclosure.

In one example, an operator of the combustion system 200 selects a profile for a combustion reaction 102 corresponding to the reference image 314*d* from FIG. 3D. After the control circuit 108 has produced the averaged image 213 from FIG. 2D, the control circuit 108 compares the averaged image 213 to the reference image 314*d*. Because the averaged image 213 of the combustion reaction 102 is not as broad as the reference image 314*d*, the control circuit 108 adjusts the combustion reaction 102 to more closely conform to the reference image 314*d*.

In one example, the control circuit causes the voltage source 207 to apply a first voltage to the electrodes 206*a*, 206*b*. The control circuit 108 further controls the voltage source 207 to apply a second voltage to the combustion reaction holder 210, which acts as a conductive counter electrode. This generates an electric field in the vicinity of the electrodes 206*a*, 206*b*, attracting the combustion reaction toward the electrodes 206*a*, 206*b* thereby widening the combustion reaction 102.

Figure 4A:
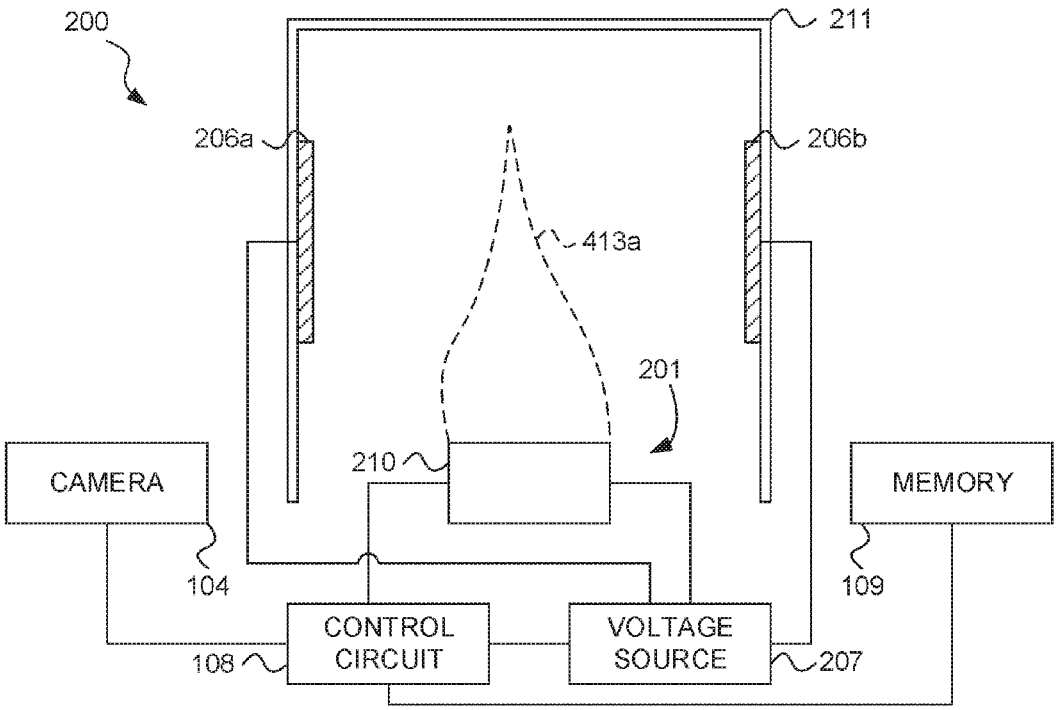
FIG. 4A is a diagram of a combustion system including an averaged image of a combustion reaction after the control circuit has adjusted the combustion reaction, according to one embodiment.

In FIG. 4A the control circuit 108 has adjusted the combustion reaction 102 from FIGS. 2A-2C by applying a voltage between the field electrodes 206*a*, 206*b* and the combustion reaction holder 210, according to an embodiment. The camera 104 has taken new images and the control circuit 108 has produced a new averaged image 413*a*. The new averaged imaged 413*a* is somewhat broader than the averaged image 213 of FIG. 2D. The control circuit 108 compares the averaged image 413*a* to the target reference image 314*d*. The averaged image 413*a* is still not broad enough in comparison to the target reference image 314*d*. The control circuit 108 therefore proceeds to adjust the combustion reaction 102 again, for example, by increasing the voltage between the electrodes 206*a*, 206*b* and the combustion reaction holder 210.

Figure 4B:
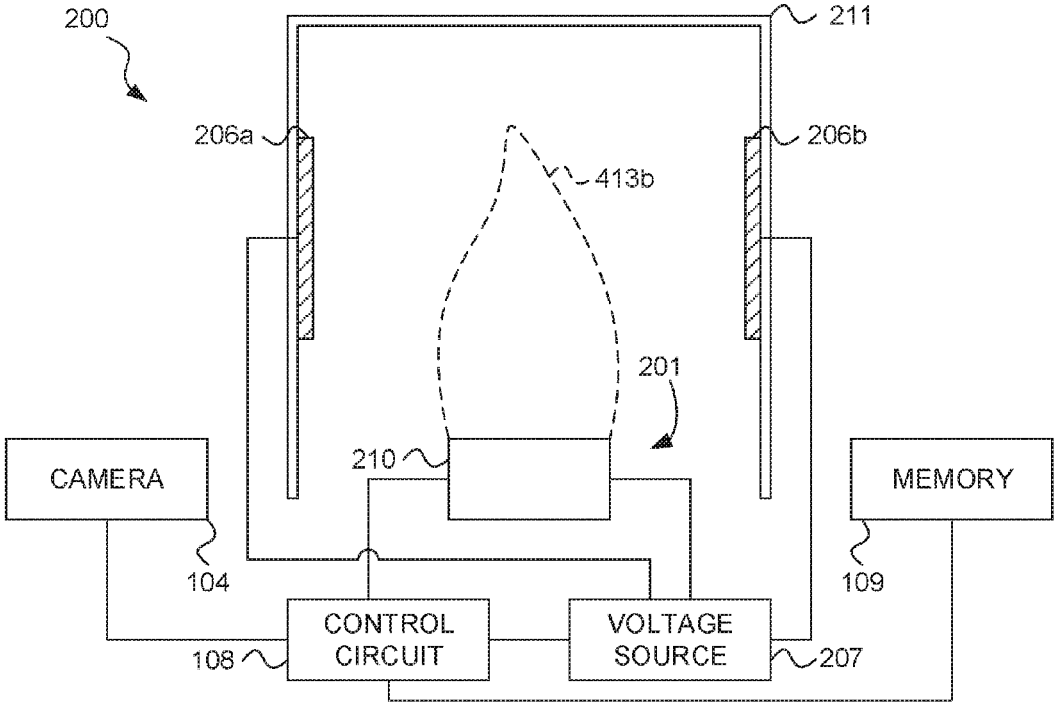
FIG. 4B is a diagram of a combustion system including an averaged image of the combustion reaction after the control circuit has further adjusted the combustion reaction, according to one embodiment.

In FIG. 4B the camera 104 again takes a plurality of images of the combustion reaction 102 and produces from them an averaged image 413*b*, according to an embodiment. The control circuit 108 compares the averaged image 413*b* to the target reference image 314*d*. The averaged image 413*b* is substantially identical to the target reference image 314*d*. The control circuit 108 therefore does not adjust the combustion reaction 102 further.

In an alternative example the control circuit 108 can cause the combustion reaction 102 to bend toward the field electrode 206*a* by applying the first voltage signal to the field electrode 206*a* while not applying the first voltage signal to the field electrode 206*b*. Likewise, the control circuit 108 can cause the combustion reaction 102 to bend toward the field electrode 206*b* by applying the first voltage signal to the field electrode 206*b* while not applying the first voltage signal to the field electrode 206*a*.

While the combustion reaction holder 210 has been disclosed as a counter electrode to the field electrodes 206*a*, 206*b*, many other structures can be used for a counter electrode to which the second voltage signal is applied. For example, the counter electrode can be a conductive fuel nozzle from which fuel is output for the combustion reaction 102. The counter electrode can also be a conductor placed in the fuel stream output from the fuel nozzle. Alternatively, the counter electrode can be a corona electrode positioned near or in the fuel stream. The counter electrode can also be a grounded surface or body near the combustion reaction 102. Those of skill in the art will understand that many other structures are possible for a counter electrode in view of the present disclosure. Likewise, a field electrode can be positioned differently than shown in the FIGS. For example, a field electrode can be placed above the combustion reaction 102 or in another position different than shown in the FIGS. Those of skill in the art will understand, in light of the present disclosure, that many arrangements are possible for electrodes to affect a combustion reaction.

In one embodiment, an electric field generated by applying the first voltage signal to the field electrodes 206*a*, 206*b* is selected to cause in the combustion reaction 102 a reduction in oxides of nitrogen (NOx) with respect to the combustion reaction 102 in an absence of the electric field. Alternatively, or additionally, the electric field is selected to cause in the combustion reaction 102 a reduction in carbon monoxide (CO) with respect to the combustion reaction 102 in an absence of the electric field.

In one embodiment, the first voltage signal is ground. Alternatively, the first and second voltages can be time varying voltages substantially opposite in polarity from each other. The first voltage signal can also comprise a chopped DC waveform or a DC offset waveform. The first voltage signal can also be an AC waveform. In one embodiment the AC waveform corresponds to a waveform stored in the memory 109.

In one embodiment the field electrodes 206*a*, 206*b* are metal. Alternatively, the field electrodes 206*a*, 206*b* can be metal covered in an insulator such as porcelain. In one embodiment, the voltage difference between the first and second voltage signals is greater than 1,000 V. In an alternative embodiment, the voltage difference between the first and second voltage signals is greater than 40,000 V.

Figure 5:
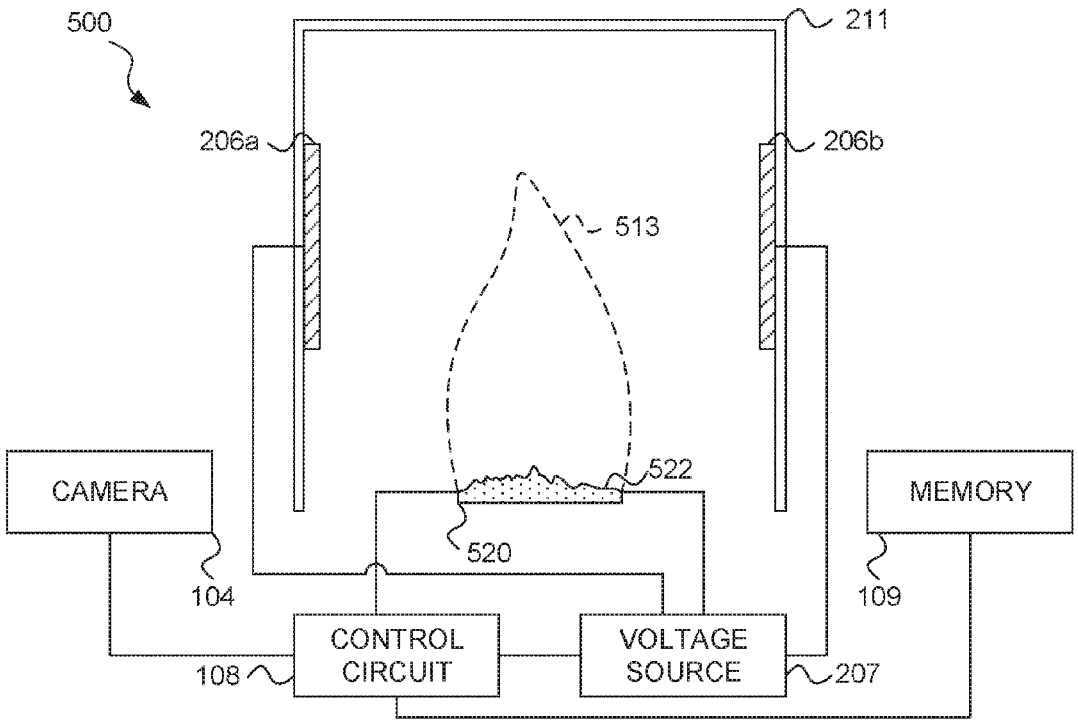
FIG. 5 is a diagram of a solid fuel combustion system including an averaged image of a combustion reaction, according to one embodiment.

FIG. 5 is a diagram of a solid fuel combustion system 500 according to one embodiment. The combustion system 500 includes a conductive grid or support 520 on which solid fuel 522 is positioned for a combustion reaction 102. FIG. 5 shows an averaged image 513 of the combustion reaction 102 of the solid fuel 522. The averaged image 513 has been produced by the control circuit 108 from a plurality of images captured by the camera 104. The control circuit 108 then compares the averaged image 513 to reference data stored in the memory 109. The control circuit 108 can then adjust the combustion reaction 102 by applying the first voltage to the field electrode 206*a* and/or the field electrode 206*b* while also applying second voltage to the conductive grid 520, which acts as a counter electrode, on which the solid fuel 522 rests.

Figure 6:
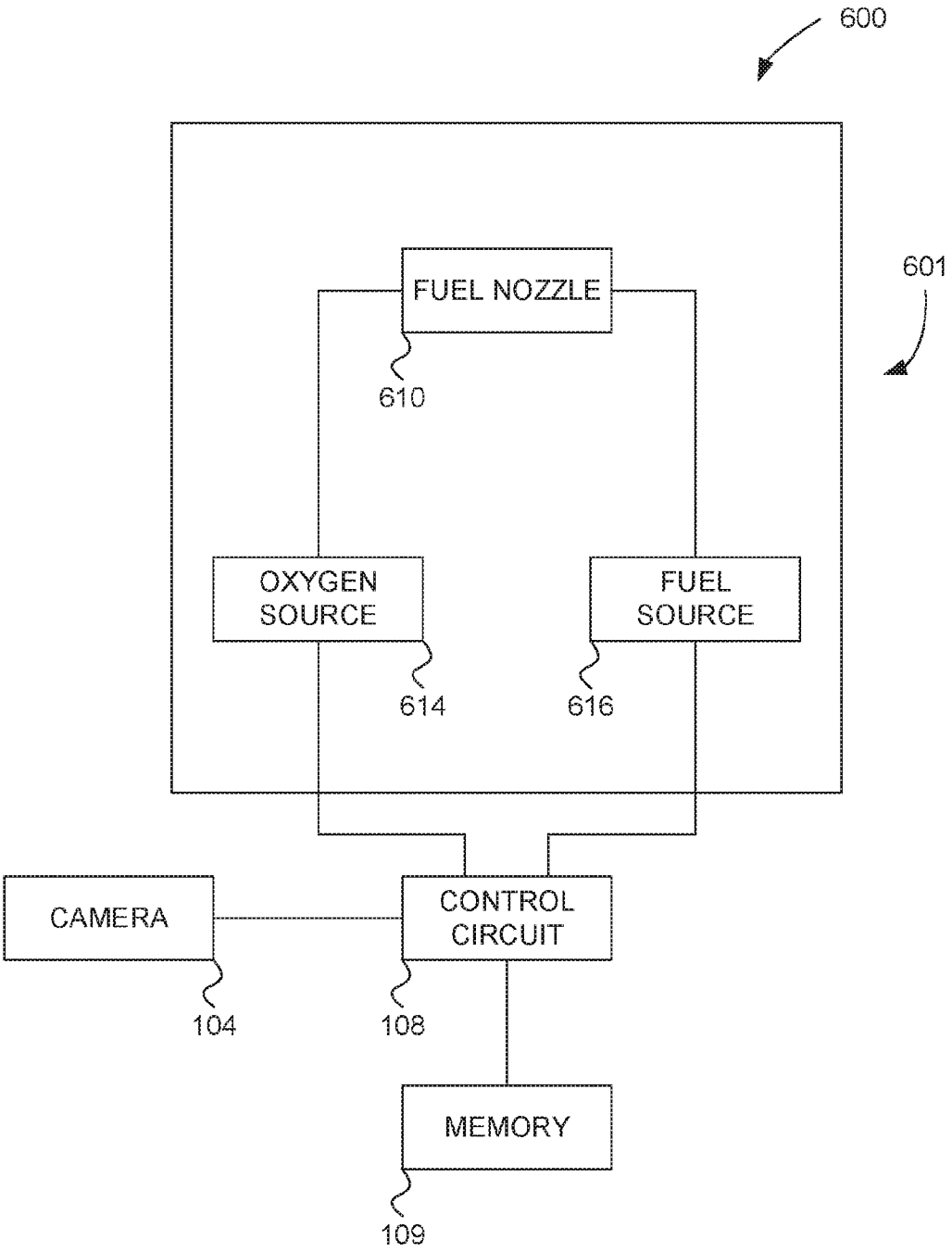
FIG. 6 is a block diagram of a combustion system including a fuel nozzle, an oxygen source, and a fuel source, according to one embodiment.

FIG. 6 is a block diagram of a combustion system 600, according to one embodiment. The combustion system 600 includes a burner 601 configured to sustain a combustion reaction (not shown). The burner 601 includes a fuel nozzle 610 coupled to oxygen source 614 and the fuel source 616. In practice, the fuel nozzle 610 can include multiple fuel nozzles.

The fuel nozzle 610 outputs a mixture of fuel from the fuel source 616 and oxygen from the oxygen source 614. The oxygen source 614 can be air or another source of oxygen.

The camera 104 catches a plurality of images of the combustion reaction 102. The control circuit makes an averaged image from the plurality of images. The control circuit 108 compares the averaged image to reference data stored in the memory 109.

The control circuit 108 is configured to adjust the combustion reaction 102 by adjusting a parameter of the fuel such as an output velocity of the fuel, an output rate of the fuel, an output direction of the fuel, and a concentration of the fuel in a mixture. Likewise, the control circuit 108 is configured to adjust the combustion reaction 102 by adjusting a parameter of the oxygen such as an output velocity of the oxygen, an output rate of the oxygen, an output direction of the oxygen, and a concentration of the oxygen in a mixture.

Figure 7:
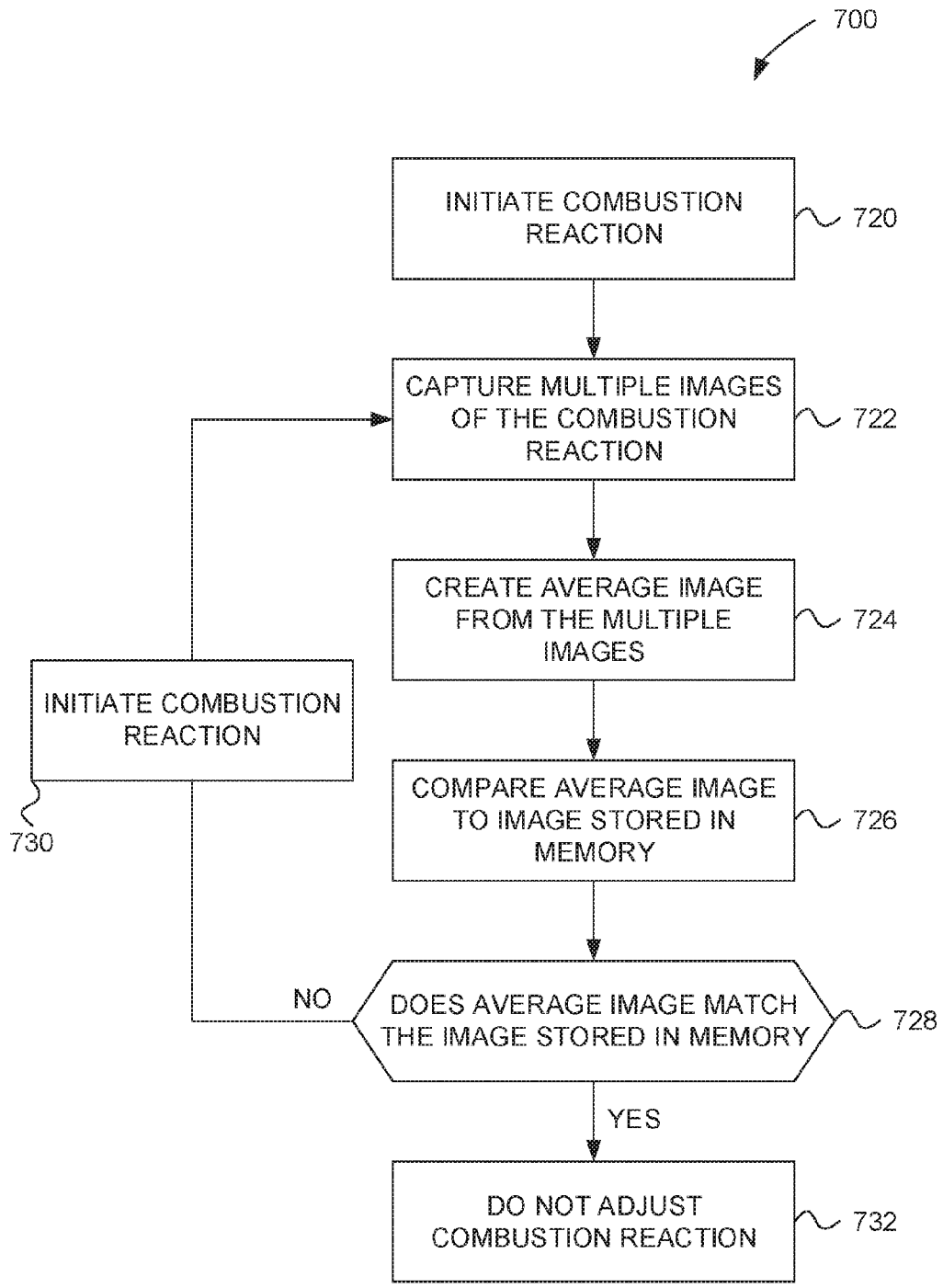
FIG. 7 is a flowchart of a process for operating a combustion system, according to one embodiment.

FIG. 7 is a flow diagram of a process 700 for operating a combustion system, according to one embodiment. At 720 a combustion reaction is initiated. The combustion reaction can be from a solid fuel, a liquid fuel or a gaseous fuel. At 722 a camera captures multiple images of the combustion reaction. At 724 a control circuit creates an averaged image from the multiple images of the combustion reaction. At 726 the control circuit compares the averaged image to a reference image stored in memory. At 728 if the comparison indicates that the averaged image substantially matches the reference image, the process proceeds to step 732 where the combustion reaction is not adjusted. If at 728 the comparison indicates that the averaged image is not a substantial match of the reference image, then at 730 the combustion reaction is adjusted. After the combustion reaction is adjusted the process is repeated starting at 722 until the combustion reaction substantially matches the reference image.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A combustion system, comprising:

a burner configured to sustain a combustion reaction;

a camera configured to capture a plurality of images of the combustion reaction; and a control circuit coupled to the camera and configured to produce from the plurality of images an averaged image of the combustion reaction; and a memory coupled to the control circuit and configured to store reference data including a plurality of combustion reaction reference images illustrative of a plurality of operating conditions.

2. The combustion system of claim 1, wherein the control circuit is configured to adjust the combustion reaction based on the averaged image.

3. The combustion system of claim 1, wherein the control circuit is configured to compare the averaged image to the reference data stored in the memory.

4. The combustion system of claim 1, wherein the control circuit is configured to adjust the combustion reaction based on the comparison between the averaged image and the reference data.

5. The combustion system of claim 4, wherein the reference data is generated by one or more flame averages collected by the system.

6. The combustion system of claim 4, wherein the reference data includes a combustion reaction reference image.

7. The combustion system of claim 5, wherein the control circuit is configured to adjust the combustion reaction to conform to the combustion reaction reference image.

8. The combustion system of claim 1, wherein the reference data corresponds to one or more data bits referencing a reference image best matched to the averaged image.

9. The combustion system of claim 1, further comprising an image display apparatus configured to display the averaged image, wherein the control circuit is configured to store the averaged image in the memory.

10. The combustion system of claim 1, comprising:

a voltage source coupled to the control circuit;

a first field electrode coupled to the voltage source and positioned in or adjacent to a flame region of the burner; and a counter electrode coupled to the voltage source, the control circuit being configured to adjust the parameter of the combustion reaction by causing the voltage source to apply a first voltage signal to the first field electrode and a second voltage to the counter electrode.

11. The combustion system of claim 10, wherein the counter electrode is a fuel nozzle configured to emit fuel for the combustion reaction.

12. The combustion system of claim 10, wherein the counter electrode is a grate configured to hold a solid fuel for the combustion reaction.

13. The combustion system of claim 10, wherein the counter electrode is a combustion reaction holder configured to hold the combustion reaction.

14. The combustion system of claim 10, wherein the counter electrode is a corona electrode.

15. The combustion system of claim 10, comprising a second field electrode positioned in or adjacent to the flame region and coupled to the voltage source.

16. The combustion system of claim 15, wherein the second field electrode receives the first voltage signal from the voltage source.

17. The combustion system of claim 16, wherein the first and second electrodes are disposed in or adjacent to walls of a furnace defining a flame region above the burner.

18. The combustion system of claim 10, wherein the first field electrode is configured to apply an electric field to the flame region.

19. The combustion system of claim 18, wherein the electric field is selected to cause in the combustion reaction a reduction in oxides of nitrogen (NOx) with respect to the combustion reaction in an absence of the electric field.

20. The combustion system of claim 18, wherein the electric field is selected to cause in the combustion reaction a reduction in carbon monoxide (CO) with respect to the combustion reaction in an absence of the electric field.

21. The combustion system of claim 10, wherein the first voltage signal is ground.

22. The combustion system of claim 10, wherein the first voltage signal is a first time-varying voltage signal and the second voltage signal is a second time-varying voltage signal condition substantially opposite in polarity from the first time-varying voltage signal.

23. The combustion system of claim 22, wherein the first time-varying voltage signal comprises a waveform selected from the group consisting of: a chopped DC waveform, a DC offset AC waveform, and an AC waveform.

24. The combustion system of claim 10, wherein the first voltage signal corresponds to a waveform stored in the memory.

25. The combustion system of claim 10, further comprising a second field electrode, wherein the first and second field electrodes are disposed in or adjacent to walls of a furnace defining a flame region above the burner.

26. The combustion system of claim 2, wherein the burner comprises one or more fuel nozzles configured to output fuel for the combustion reaction.

27. The combustion system of claim 2, wherein the control circuit is configured to adjust the combustion reaction by adjusting a parameter of the fuel.

28. The combustion system of claim 27, wherein the parameter of the fuel includes one or more of an output velocity of the fuel, an output rate of the fuel, an output direction of the fuel, an output of mass flow of air, an output of fuel/air ratio, an output of volumetric flow of air, an output of air velocity, and a concentration of the fuel in a mixture.

29. The combustion system of claim 26, wherein one or more of the fuel nozzles are configured to output oxygen for the combustion reaction, and wherein the control circuit is configured to adjust the combustion reaction by adjusting a parameter of the oxygen.

30. The combustion system of claim 29, wherein the parameter of the oxygen includes one or more of an output velocity of the oxygen or air, an output rate of the oxygen or air, an output direction of the oxygen or air, and a concentration of the oxygen in a mixture.

31. The combustion system of claim 1, wherein the memory is a non-transitory computer-readable memory configured to the store reference data.

* * * * *